US007114446B2

(12) United States Patent
Sellars

(10) Patent No.: US 7,114,446 B2
(45) Date of Patent: Oct. 3, 2006

(54) EXTENDED WRAP LABEL AND METHOD OF MAKING SAME

(75) Inventor: Neil G. Sellars, Cinnaminson, NJ (US)

(73) Assignee: National Label Co., Lafayette Hill, PA (US)

( * ) Notice: Subject to any disclaimer, the term of this patent is extended or adjusted under 35 U.S.C. 154(b) by 0 days.

(21) Appl. No.: 10/896,763

(22) Filed: Jul. 22, 2004

(65) Prior Publication Data

US 2005/0076549 A1 Apr. 14, 2005

Related U.S. Application Data

(60) Division of application No. 10/284,713, filed on Oct. 31, 2002, now Pat. No. 6,770,345, and a continuation-in-part of application No. 09/404,429, filed on Sep. 23, 1999, now Pat. No. 6,613,410.

(60) Provisional application No. 60/334,738, filed on Oct. 31, 2001.

(51) Int. Cl.
*B41F 1/34* (2006.01)

(52) U.S. Cl. ..... 101/485; 101/226; 428/41.8

(58) Field of Classification Search ..... 101/226, 101/483, 485; 428/306, 310, 41.8, 41.9, 428/42.1, 42.2, 42.3, 192, 194, 201, 202, 428/220; 40/638, 630, 306, 310
See application file for complete search history.

(56) References Cited

U.S. PATENT DOCUMENTS 1,756,944 A * 5/1930 Gorton, Jr. ..... 40/306
3,524,782 A * 8/1970 Buske ..... 156/248
3,673,953 A * 7/1972 Massari ..... 101/19
4,307,900 A * 12/1981 Krautsack ..... 283/56
4,324,058 A * 4/1982 Sherwick et al. ..... 40/310
4,727,667 A * 3/1988 Ingle ..... 40/306
5,342,093 A * 8/1994 Weernink ..... 283/81
5,376,418 A * 12/1994 Rogers et al. ..... 428/41.7
5,518,787 A * 5/1996 Konkol ..... 428/43
5,618,600 A * 4/1997 Denklau ..... 428/41.8
6,073,377 A * 6/2000 Mehta ..... 40/638
6,327,801 B1 * 12/2001 Witkowski ..... 40/306
6,331,018 B1 * 12/2001 Roth et al. ..... 283/81

FOREIGN PATENT DOCUMENTS

JP 405346764 A * 12/1993
JP 410245021 A * 9/1998

* cited by examiner

*Primary Examiner*—Ren Yan
(74) *Attorney, Agent, or Firm*—Reed Smith LLP

(57) ABSTRACT

A method for providing a label being suitable for being adhered about an object having a outer circumference once removed from a release liner, the label having a length greater than the circumference of the object and the release liner providing a mechanical support for the label prior to be adhered about the object, the method including: printing at least a portion of the label with indicia; printing at least a portion of the release liner with indicia; and, at least partially severing the printed portion of the release liner from the release liner such that upon removal of the label from the release liner, the printed portion of the release liner remains releasably adhered to the label.

1 Claim, 11 Drawing Sheets

EXTENDED WRAP LABEL AND METHOD OF MAKING SAME

RELATED APPLICATIONS

This application is a division of U.S. patent application Ser. No. 10/284,713 filed Oct. 31, 2002 now U.S. Pat. No. 6,770,345, entitled EXTENDED WRAP LABEL AND METHOD OF MAKING SAME, which claims priority of U.S. Patent Application Ser. No. 60/334,738, entitled EXTENDED WRAP LABEL, and filed Oct. 31, 2001, and is a continuation-in-part application of U.S. patent application Ser. No. 09/404,429, entitled EXTENDED WRAP LABEL, filed Sep. 23, 1999 now U.S. Pat. No. 6,613,410, the entire disclosures of which are hereby incorporated by reference as if being set forth in the respective entireties herein.

FIELD OF THE INVENTION

The present invention relates in general to labels and, more particularly, to labels for products and product containers.

BACKGROUND OF THE INVENTION

Labels, typically in the form of flexible sheet or web material attached to an object, have long been used to identify the object, its contents and/or display other information associated with the object. Such labels, which are normally fabricated from paper or plastic, are usually adhesively secured to the object by a contact or pressure sensitive adhesive material.

Many objects such as jars, bottles, cans and similar receptacles support "wrap" labels which cover substantially all of their circumferential side wall surfaces. With these labels, essentially the entire outer surface of the label is available as an indicia bearing surface. A label covering all or nearly all of the circumferential area of an object such as a product container is oftentimes sufficient to convey desired advertising, content information, instructions, warnings, and the like. In many circumstances, however, an object's physical dimensions detrimentally limit the available print space of the label borne thereby.

SUMMARY OF THE INVENTION

A method for providing a label being suitable for being adhered about an object having a outer circumference once removed from a release liner, the label having a length greater than the circumference of the object and the release liner providing a mechanical support for the label prior to be adhered about the object, the method including: printing at least a portion of the label with indicia; printing at least a portion of the release liner with indicia; and, at least partially severing the printed portion of the release liner from the release liner such that upon removal of the label from the release liner, the printed portion of the release liner remains releasably adhered to the label.

BRIEF DESCRIPTION OF THE DRAWINGS

The invention will become more readily apparent from the following description of preferred embodiments thereof shown, by way of example only, in the accompanying drawings wherein.

DETAILED DESCRIPTION OF THE INVENTION

According to an aspect of the present invention, there is provided a unitary label suitable for attachment to an object having a circumference. The label includes a first label portion; a first adhesive means for affixing the first label portion about the circumference of the object; and a second label portion substantially contiguous with the first label portion and operable to overlie the first label portion when the label is affixed to the object, wherein the first label portion and the second label portion have a combined length which is greater than the circumference of the object.

Figure 1:
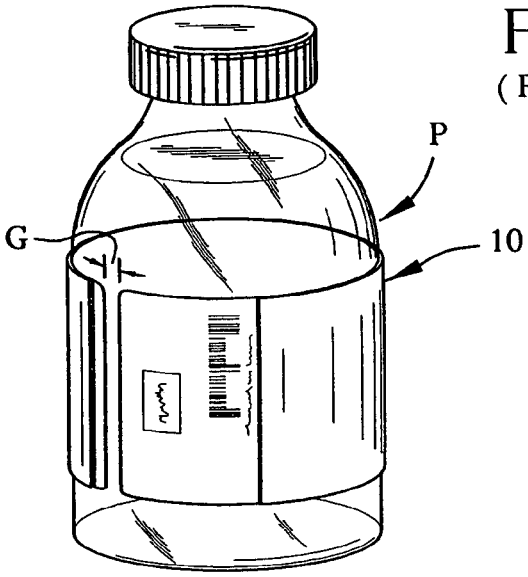
FIG. 1 ( Prior Art )
FIG. 1 is a perspective view of a conventional wrap-type label affixed to a product container.

Referring to FIG. 1, there is shown an object such as a product container P, e.g., a bottle, jar, or the like. Adhesively affixed about the circumferential side wall of container P is a wrap-type label 10. Label 10, as is conventional, may cover any fraction of the circumferential side wall of container P. As illustrated, label 10 is constructed as an elongated strip member spanning nearly the entire circumference of container P such that the ends of the label are separated by small gap G. The available printing area of such a label is limited by the area, (i.e., length and width) dimensions of the label. Additionally, printing is normally carried only by the exposed exterior surface of the label.

Figure 2:
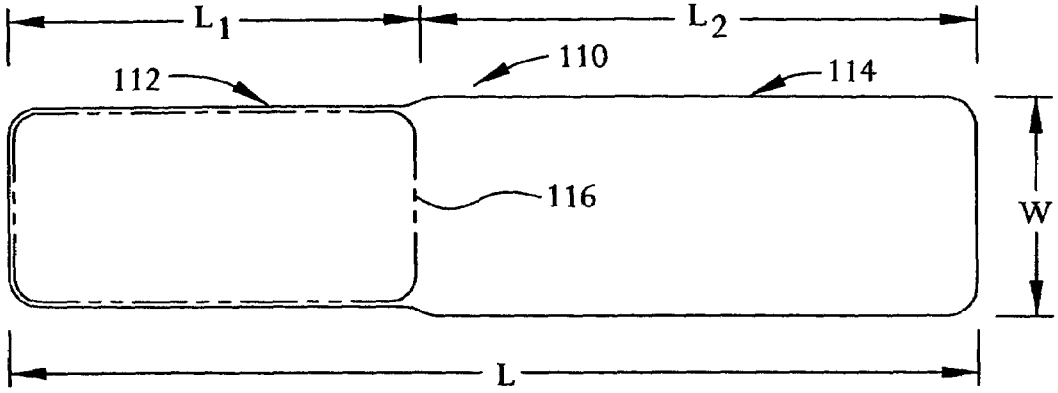
FIG. 2 is a top plan view of an embodiment of a label constructed in accordance with the present invention.
Figure 3:
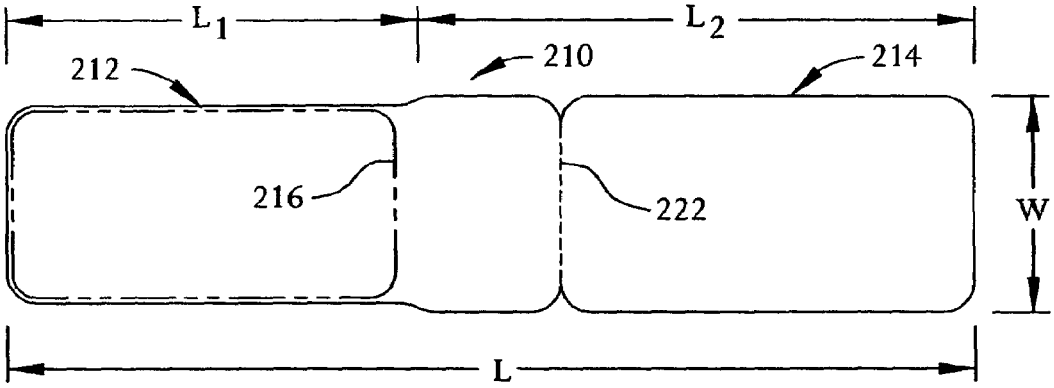
FIG. 3 is a top plan view of an embodiment of a label constructed in accordance with the present invention.
Figure 4:
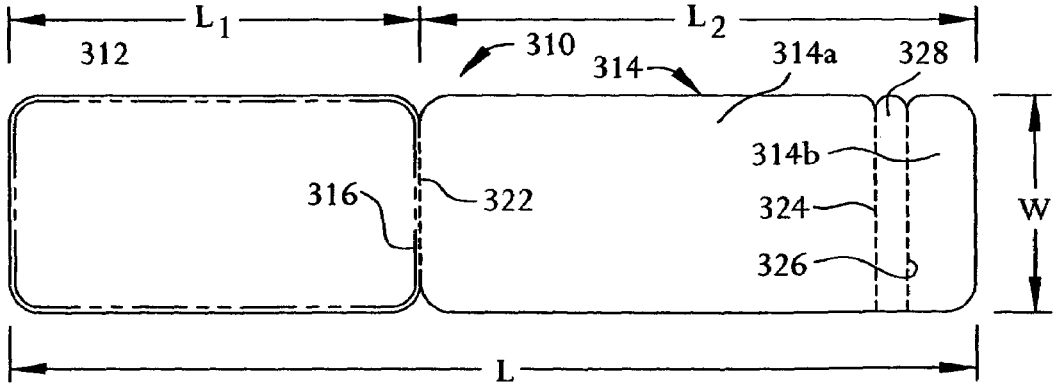
FIG. 4 is a top plan view of an embodiment of a label constructed in accordance with the present invention.

FIGS. 2, 3 and 4 depict several embodiments of labels according to an aspect of the present invention. Furthermore, as will be described in greater detail in connection with FIGS. 3 and 4, labels constructed in accordance with an aspect of the present invention may incorporate structural features which impart additional functionality to the label.

Labels according to the present invention, respectively identified by reference numeral 110 in FIG. 2, 210 in FIGS. 3 and 310 in FIG. 4, include several common characteristic features. For instance, each may be comprised of a flexible and printable substrate such as paper or plastic sheet or web material. Although they may be made individually, such labels may be produced from rolls of substrates, such as paper or plastic sheet stock which can be continuously printed, coated with adhesive, applied with protective material, affixed to release paper, and cut to produce multiple labels as further described herein. Additionally, each label has general area dimensions L and W which represent the length and width dimensions, respectively, of the label. Length L is a predetermined distance related to the circumferential dimension of the object to be labeled and width W is that dimension extending substantially perpendicularly to length L. Width W may vary, as may be desired or necessary, along length L.

As used herein, the terms "circumferential," "circumference," or variants thereof shall be construed to include any distance circumscribing the perimeter of the target object to be labeled. The object may comprise a polygonal shape (e.g., square or rectangular), curvilinear shape (e.g., circular or oval) or composite polygonal and curvilinear cross-sectional configuration defining a desired perimetrical exterior wall surface to be covered by label 110, 210, 310, 410, 510, 610, 710 or any other label disclosed herein.

Labels 110, 210 and 310 each include first portion 112, 212 and 312, respectively, having a length L. $L_1$ is preferably less than or equal to the circumferential dimension of the object to be labeled. In addition, labels 110, 210 and 310 include second portions 114, 214 and 314, respectively, of length $L_2$ which are contiguous with first portions 112, 212 and 312. "Contiguous", as used herein, generally refers to not only in contact with, but near to as well. Second label portions 114, 214 and 314 provide additional length to first label portions 112, 212 and 312 such that the total length L of the labels 110, 210 and 310 is greater than the circumference of the object to be labeled. All or a portion of the underside of first label portions 112, 212 and 312 may be coated with a layer of pressure sensitive, or other, adhesive having sufficient tackiness to essentially affix the label on the target object, such adhesive being respectively identified by dot-dash lines 116, 216 and 316.

Each of the second label portions 114, 214 and 314 may provide additional print space to labels 110, 210 and 310. Indeed, both the top and bottom surfaces of the second label portions may be available as printable surfaces. Further, depending on which of certain other structural features, described below, are incorporated into the label of the present invention, second label portions 114, 214 and 314 may function, without limitation, as resealable and/or removable flaps.

The length $L_2$ of second portions 114, 214 and 314 may be dictated by, inter alia, the need for additional print space. One practical limitation of the second label portion length $L_2$ and, hence, the overall length L of labels 110, 210 and 310 may be such, if length L results in multiple wraps of the second label portion 114, 214 and 314 about the target object, the several superimposed label layers may produce a label whose bulk and thickness rivals those of presently available two-part (base label and leaflet) label constructions.

A label may include any number of wraps of the second label portion about the target object. In fact, a multiple wraps embodiment of this invention may be preferable to known leaflet labels because multiple wraps provide, in most cases, an equal or greater amount of print area than would an equivalent leaflet label while providing a substantially uniform overall diameter to container P. A leaflet label providing an equivalent amount of print area may produce a bulge on the side wall of container P at the point where the leaflet is located thereby creating a non-symmetric overall cross section to container P, for example.

Referring more specifically to FIGS. 2, 3 and 4, FIG. 2 represents a relatively simple expression of the present invention. According to this embodiment, label 110 comprises first and second portions 112, 114 which are contiguous regions of an elongated unitary strip of material. No perforation exists between first and second label portions 112 and 114. Physical demarcation between first label portion 112 and second label portion may be established by the rightmost edge of pressure sensitive adhesive 116 underlying first portion 112. The boundary between the first and second label portions 112 and 114 may also be distinguished by a change in width W and/or the printed image carried on the label, for example.

Figure 5:
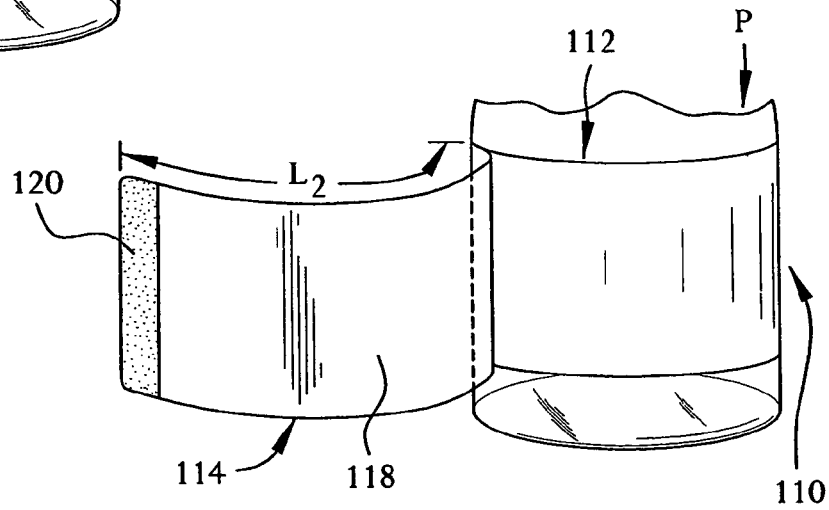
FIG. 5 is a perspective view of a label constructed according to present invention with a releasable end thereof lifted from the surface of a product container to which the label is affixed.
Figure 6:
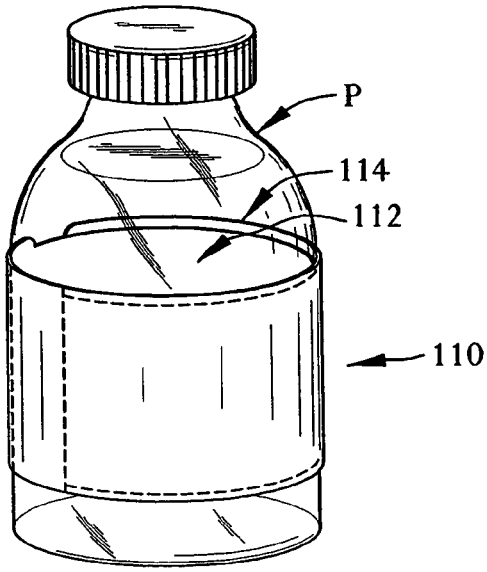
FIG. 6 is a perspective view of the label of FIG. 5 with a releasable end thereof attached to the surface of the product container to which the label is affixed.

FIGS. 5 and 6 are sequential views of the label 110 being applied to an object, e.g., a product container P.

Referring initially to FIG. 5, first label portion 112 of label 110 is shown wrapped about and adhered about a circumference of container P. Second label portion 114 is depicted in a lifted and turned-away disposition to expose the bottom surface 118 thereof. Both the top and bottom surfaces of second portion 114 are available as printable surface areas. To enhance the utility of label 110, a comparatively narrow strip of tack adhesive material 120 may be provided along the distal edge of the bottom surface 118 of the second label portion 114. Alternatively, tack adhesive 120 may be applied in any pattern and to any area of bottom surface 118 of second portion 114 and to as much as the entire bottom surface 118. The tackiness of adhesive material 120 should be such that it may enable the second label portion 114 to be selectively and repeatedly adhered to the first label portion 112 substantially in the manner shown in FIG. 6 and released from the first label portion as in FIG. 5 to expose the bottom surface 118 of second label portion 114 at the end user's discretion. Preferably, where a strip of tack adhesive 120 is employed, the label stock may be coated with adhesive to enable the strip to releasably adhere to the top surface of the first label portion.

Although second label portion 114 may be of any length, an example illustrates a degree to which a second label portion 114 of relatively moderate length increases the available print surface area of label 110. Assuming that product container P is a generally cylindrical jar or bottle such as in FIGS. 5 and 6, length L of the first portion 112 of label 110 may be selected to be substantially equal to that of the circumference of container P. Recalling that both the top and bottom surface of the second label portion 114 may be printed, if length $L_2$ of the second portion 114 is chosen so as to extend for an additional 360° of arc about the circumference of container P, then the total available print surface area is increased by 200% as compared to the available print surface area of conventional 360° wrap labels. That is, 720° of additional printable surface area may be provided in the form of no more than two superimposed layers wrapped about container P. As a consequence, a compact, low-bulk and low thickness resultant label construction is produced which offers essentially three times the print area of a presently existing wrap label such as label 10 of FIG. 1.

FIG. 3 represents a further embodiment of the present invention. According to FIG. 3, label 210 is substantially similar in construction to label 110. Hence, only those features which materially distinguish label 210 from label 110 will be described in detail.

Unlike label 110, label 210 includes a perforation 222 which may be placed at or, as illustrated, near the boundary between the first label portion 212 and the second label portion 214. Although not illustrated, second label portion 214 may also include a thin strip of tack adhesive on the bottom surface and at the distal end thereof similar to adhesive material 120 of label 110 (FIG. 5) or in any pattern or to any area of the bottom surface of the second portion. So disposed, the tack adhesive may serve to retain the second label portion 214 in contact with the first label portion 212 until deployment of the second label position is desired. In this way, some or all of the second label portion 214 may be torn from the first label portion 212 along perforation 222 to expose the surface of the first label portion previously covered by the second label portion. Additionally, the second label portion according to this embodiment may be adapted for a use, once detached from the first label portion, that is independent of the function of the first label portion. For instance, second label portion 214 may be printed with information such that it may function as a redeemable coupon for consumer merchandise.

FIG. 4 represents an embodiment of the label according to the invention. Label 310 depicted therein, like label 210, includes a perforation 322 generally at or near the boundary between first label portion 312 and second label portion 314. Additionally, second label portion 314 is provided with a pair of comparatively closely spaced perforations 324 and 326 disposed adjacent the end of the second label portion 314 opposite the first label portion 312. Perforations 324, 326 together define a removable tear strip 328, described below, which separates the second label portion 314 into a first non-adhesive-bearing, removable segment 314*a* and a second adhesive-bearing segment 314*b*. Alternatively, a single perforation may be located in second label portion 314 in order to separate second label portion 314 from segment 314*b*.

The bottom surface of the second label segment 314*b* is preferably coated with a pressure sensitive or other adhesive (not illustrated), that may be similar to adhesive 316 provided on the first label portion 312. In this way, when label 310 is fully wrapped about an object such as product container P such as that shown in FIGS. 1, 5 and 6, the first label portion 312 is essentially affixed about the circumferential wall of the container and the second segment 314*b* of the second label portion 314 is similarly affixed to the first label portion 312. Alternatively, if $L_2$ is greater than the circumference of container P, second segment 314*b* of second label portion 314 may be affixed to second label portion 314.

With respect to the embodiment shown in FIG. 4, in order to detach the first removable segment 314*a*, therefore, an end user may simply grasp and pull the tear strip 328 (which may have no, or substantially no adhesive on its bottom surface, although it may contain adhesive on such surface) thereby severing the tear strip from the first and second segments 314*a*, 314*b* along perforations 324, 326. Thereafter, the user may grasp and pull the first segment 314*a* to sever it from the first label portion 312 along perforation 322. At this stage, the area of the first label portion 312, as well as any area of second label portion 314, previously covered by the first label segment 314*a* of the second label portion 314 is exposed. And, if so designed, the detached first label segment 314 may perform an additional function, e.g., as a redeemable coupon or the like. Additionally, tack adhesive 120 (not shown in FIG. 4) may also be added to the bottom surface of segment 314*a* in a fashion similar to that for labels 110 and 210 in order to provide a resealable means for segment 314*a*. And, if so designed, the first label segment 314 may perform an additional function, e.g. as a resealable segment.

Figure 7:
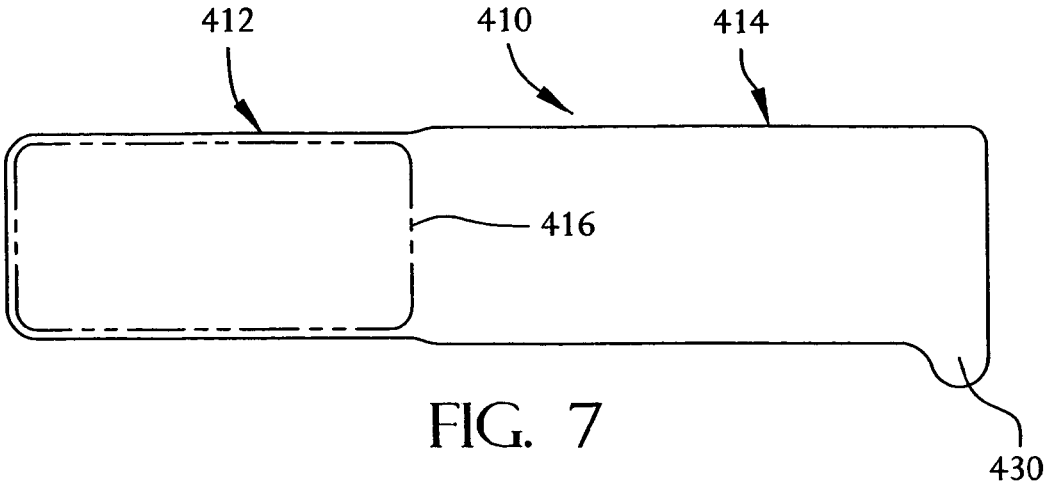
FIGS. 7, 8 and 9 are top plan views of labels according to the present invention including means for facilitating separation of a second portion of the label from a first portion thereof.
Figure 8:
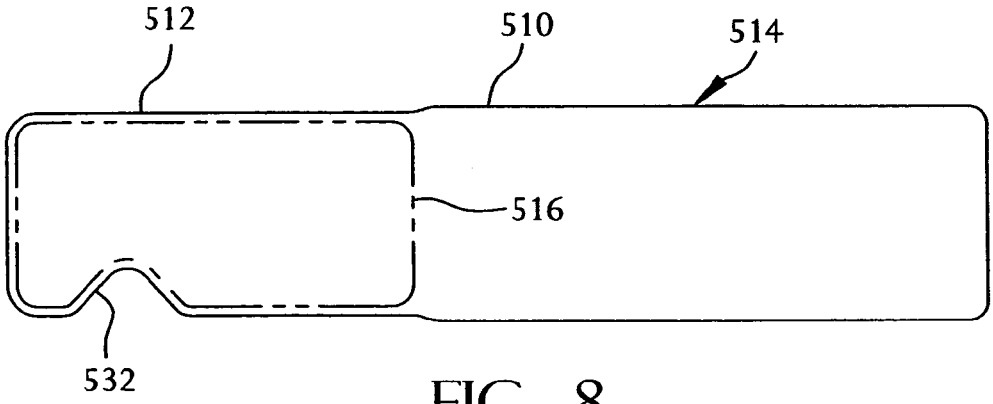
Figure 9:
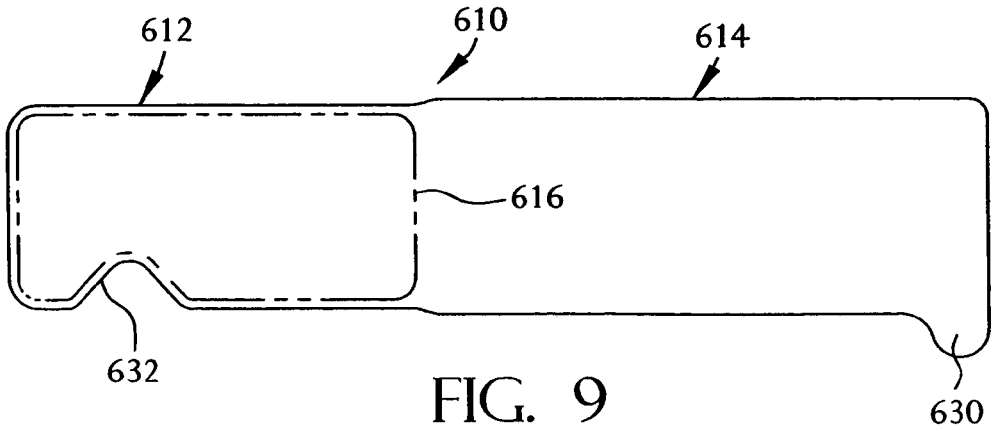

FIGS. 7, 8 and 9 illustrate further embodiments of a product label constructed according to the present invention, identified respectively by reference numerals 410, 510 and 610. It will be understood that labels 410, 510 and 610 may be constructed substantially similarly to any of the label embodiments disclosed herein including, but not limited to, labels 110, 210 and 310 described above or label 710 discussed below. Hence, only those structural aspects of labels 410, 510 and 610 which materially depart from those previously addressed, or whose description may otherwise be necessary for a proper understanding of the invention, will be described in detail.

More particularly, labels 410, 510 and 610 depict exemplary, although not limitative, means for facilitating separation of the releasable second portions of the labels from the first portions thereof when the labels are secured to objects such as products or product containers. These means may include a protrusion 430 provided substantially adjacent a distal end of the second portion 414 of label 410, a notch 532 substantially adjacent an end of the first portion 512 of label 510, or a combination of a notch 630 adjacent a distal end of second portion 614 and a notch 632 substantially adjacent an end of the first portion 612 of label 610 "substantially adjacent" is intened to include "functionally rear" as will be understood by those possessing an ordinary skill in the pertintent arts as used herein. Each of these means may enable easier insertion of a user's finger or fingernail beneath the releasable second portion of any of the labels herein described when such labels are affixed to a product or product container whereby the second label portion may be more easily lifted and separated from contact with the first label portion.

Figure 10:
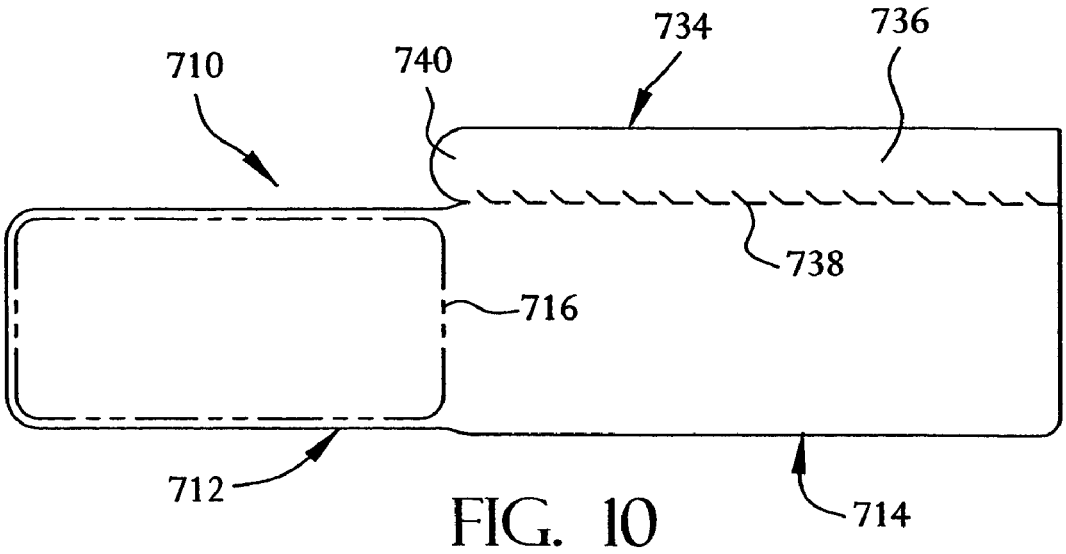
FIG. 10 is a top plan view of an embodiment of a label constructed according to the present invention having a tear strip.
Figure 11:
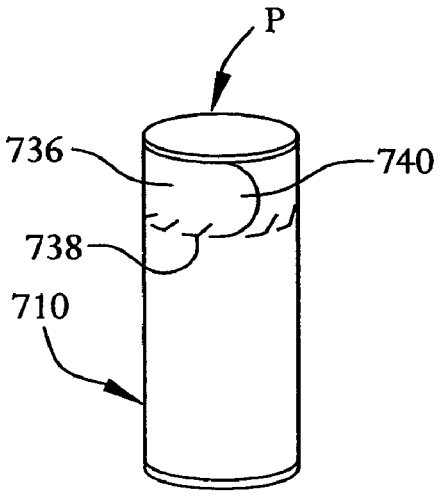
FIG. 11 is a perspective view of the label of FIG. 10 shown wrapped about the circumference of a substantially cylindrical product container.
Figure 12:
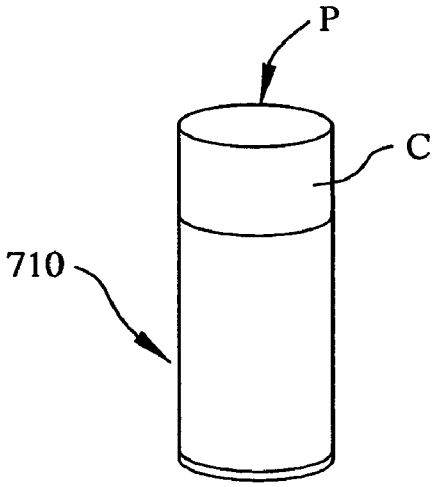
FIG. 12 is a perspective view similar to FIG. 11 with said tear strip removed.

FIGS. 10, 11 and 12 illustrate an embodiment of a product label 710 constructed in accordance with the present invention. Label 710 may be manufactured in a substantially similar manner to and/or incorporate any combination of the features of previously described labels 110 through 610. Hence, only those features of label 710 not earlier mentioned will be discussed in detail.

Label 710 preferably includes means 734 for evidencing tampering of product prior to consumption thereof by an end user, such as product contained within a hollow of a container which label 710 is affixed about. According to an aspect of the present invention, tamper evident means 734 may include an a fixed or disposable tear strip 736 contiguous with either the first, the first and second or, as shown, the second portion 714 of label 710 along perforation 738. Tear strip 736 may be of any length, but may typically correspond to the length of the circumference of P shown in FIG. 12.

FIG. 11 shows label 710 as it may appear when affixed about the circumferential side wall of a substantially cylindrical product container P. To assure its attachment to the product container prior to removal, all or a portion of the tear strip 736 may be provided with a pressure sensitive or other suitable adhesive. When it is desired to access the contents of container P, the end user may simply lift a distal end flap 740 of the tear strip 736 and pull the strip away from the remainder of the label 710 such that the strip detaches from the label along perforation 738. Upon removal, the tear strip may then be discarded.

Once tear strip 736 is removed, the product container cap or lid C may be at least partially exposed thereby enabling the user to remove the cap and access the contents of the product container P. Should the end user discover however that, prior to purchase or use, that tear strip 736 is missing or damaged, tamper evident means 734 alerts the user that consumption of the contents of product container P should possibly be avoided.

Alternatively, distal end flap 740 may be omitted from tear strip 736. Tear strip 736 may be temporarily or permanently affixed to cap C and, instead of the end user tearing away tear strip 736, the end user may remove cap C by twisting or pulling thereby breaking perforation 738 and alerting a subsequent user that the container had been previously opened. In this embodiment, tear strip 736 may either be removed from or remain attached to cap C.

Figure 18:
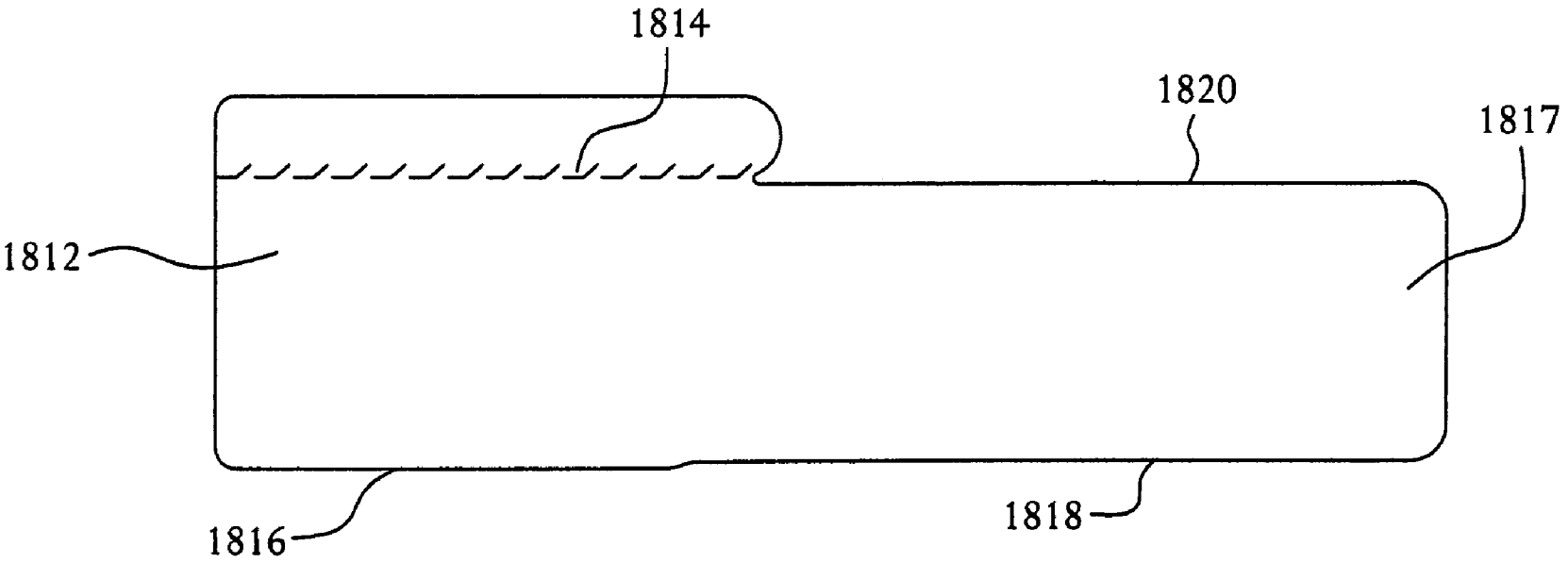
FIG. 18 is a top plan view of a further embodiment of a label constructed in accordance with the present invention.

Referring now to FIG. 18, there is an embodiment of a product label 1800 constructed in accordance with the present invention. The label 1800 is essentially identical to the label shown in FIG. 10, except that the label 1800 is adapted to be applied to irregularly shaped objects, particularly tapered objects. Label 1800 has a first portion 1812 with a top edge 1814 and a bottom edge 1816. Label 1800 also includes a second portion 1817 with a top edge 1818 and a bottom edge 1820. To accommodate application to a tapered object having a top with a larger circumference than the bottom, the top edges 1814 and 1820 are longer than the corresponding bottom edges 1816 and 1818. In addition, the first portion 1812 may be oriented at an oblique angle relative to the second portion 1817. The relative length of the top and bottom edges and the angle between the first and second portions depend upon the shape and size of the article to which the label is to be applied, for example. Generally, the greater the taper of the article, the greater the angle and the greater the difference between the length of the top and bottom edges, and vice versa. The specific lengths and angle may be selected so that the second portion 1817 substantially precisely overlaps the first portion 1812 when the label 1800 is wrapped more than 360° around an article. Alternatively, the specific lengths and angle may be selected so that the second portion 1817 only partially overlaps the first portion 1812 and partially contacts the container when the label 1800 is wrapped more than 360° around an article. Some or all of the edges may be curved to accommodate the difference in length between the top edges and the bottom edges. In FIG. 18, the top edge 1820 of the second portion 1817 is curved. According to an aspect of the invention, the second portion may include one or more sub-sections, wherein each sub-section is at an angle relative to the adjacent preceding sub-section and said angle is selected to fit the geometry of the object to which the label is to be applied.

As mentioned above, the label of this invention may be comprised of a flexible and printable substrate such as paper or plastic (such as, for example, polyvinyl chloride, polyethylene or polypropylene) sheet or web material. Although each label may be made individually, labels may be produced from rolls of such substrate such as sheet stock which can be continuously printed, coated with adhesive, affixed to release paper, and cut to produce multiple labels. One or more areas or surfaces of the label may also be coated with a lacquer or varnish in order to protect the label and/or printed inks from wear or other degradation. In view of, or in addition to, the protective lacquer or varnish, an additional layer of protective material (e.g. a substantial transparent layer of plastic such as polyvinyl chloride, polyethylene or polypropylene) may be applied to select surfaces or areas of the label. The means by which the labels will be made may depend, in part, upon the features which are to be incorporated into such labels.

Figure 13:
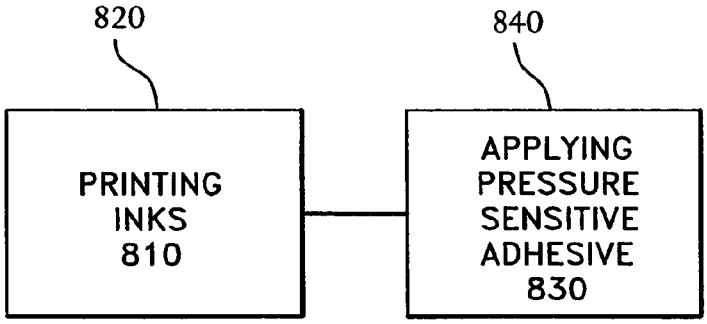
FIG. 13 is a schematic depicting a method for making the labels of this invention.

Referring to FIG. 13, there is shown a schematic depicting a method for making labels according to an aspect s of the present of this invention. It should be noted at the outset that the order in which the steps of the methods herein disclosed are carried out is not necessarily critical to successfully making such labels. As mentioned above, such labels may be made from a flexible and printable substrate 800. Graphic or other inks 810 are printed by printing step 820 (e.g. by flexographic, rotogravure, silk screening or other printing methods) at predetermined locations on the top and/or bottom surfaces of substrate 800. For example, depending on the desired or necessary label configuration, inks 810 may be applied to: the top surface of first label portion 112, 212, 312, 412, 512, 612, or 712; the top surface of second label portion 114, 214, 314*a*, 414, 514, 614, or 714; and/or the bottom surface of second label portion 114, 214, 314, 414, 514, 614, or 714. Pressure sensitive adhesive 830 may be applied 840 (e.g. hot melt or other adhesive means) to predetermined locations on the bottom surface of substrate 800 so as to provide a means by which the label may be affixed to the desired object. For example, depending on the desired or necessary label configuration, pressure sensitive adhesive 830 may be applied to the bottom surface of the first label portion 112, 212, 312, 412, 512, 612, or 712.

Figure 14:
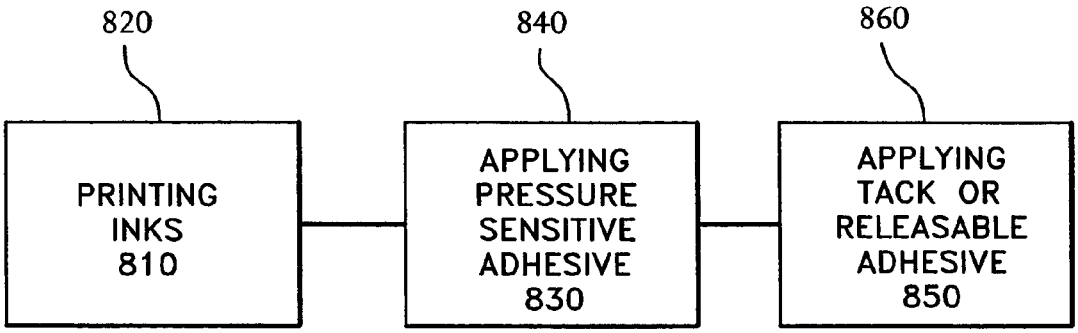
FIG. 14 is a schematic depicting a further method for making the labels of this invention.

FIG. 14 depicts a method for making the labels according to aspects of the present invention which adds to the steps shown in FIG. 13, optional step 860 for applying tack or releasable adhesive 850 to select locations on substrate 800 such that the second label portion may be selectively and repeatedly adhered to the first label portion. For example, depending on the desired or necessary label configuration, tack or releasable adhesive 850 maybe applied to the distal edge of the bottom surface of first label portion 112 (i.e. 118), 212, 312, 412, 512, 612, or 712.

Figure 15:
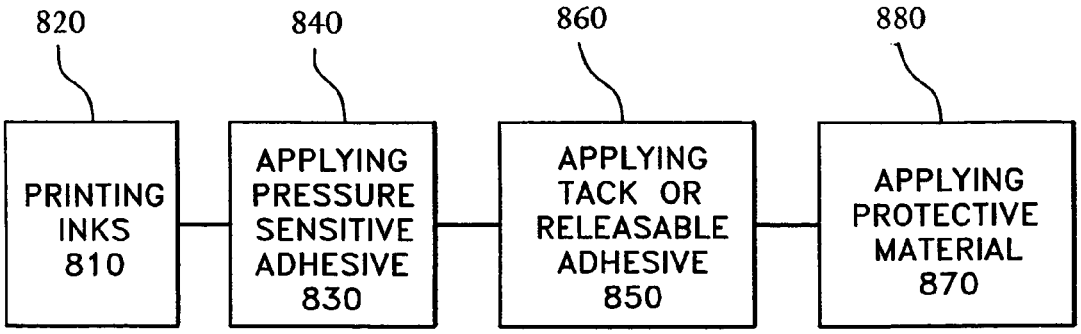
FIG. 15 is a schematic depicting yet a further method for making the labels of this invention.

FIG. 15 depicts a method for making labels which adds to the steps shown in FIG. 14, optional step 880 for applying a protective material 870 to select locations over substrate 800 and/or inks 810 in order to protect substrate 800 and/or inks 810 from wear or other degradation. For example, depending on the desired or necessary label configuration, protective material 870 (e.g. lacquer, varnish, PVC, or other substantially transparent protective material) may be applied to any suitable surface. In addition, it should be noted that either adhesive 830 or 850 may be applied over protective material 870, provided that such application does not cause an adverse chemical reaction.

Figure 16:
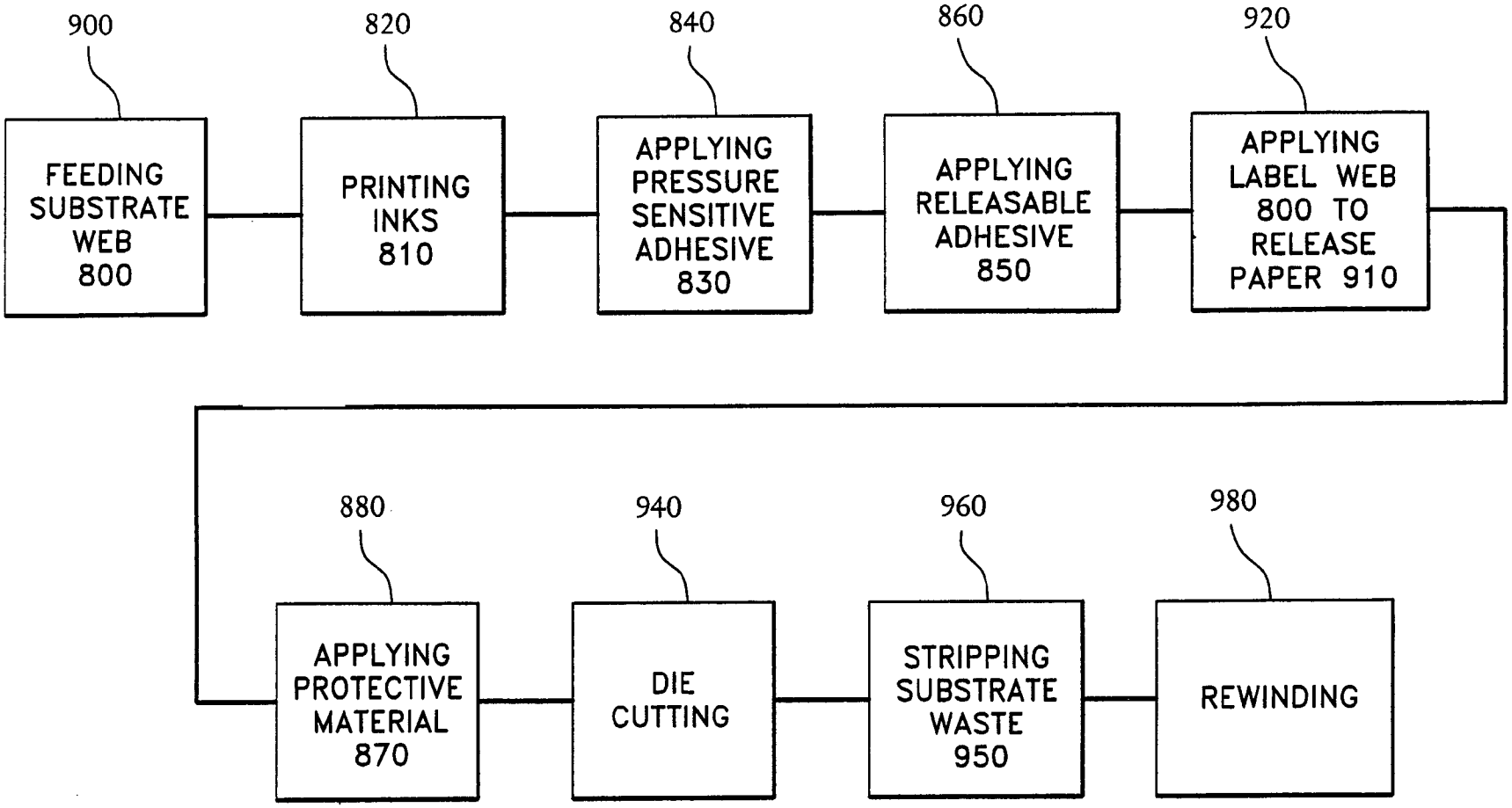
FIG. 16 is a schematic depicting yet another method for making the labels of this invention.

FIG. 16 depicts a method for making labels which adds additional optional steps to the steps shown in FIG. 15. In this embodiment, substrate 800 is in the form of a web in order to facilitate the production of larger quantities of labels. Specifically, in step 900 substrate web 800 is fed through a series of process steps. Each such step is represented schematically by a box in FIG. 16.

As indicated above, the order in which the steps are carried out is not necessarily critical to the successful manufacture of the labels of this invention. With this in mind, inks 810 may be printed on one or both sides of web 800 in printing step 820. Pressure sensitive adhesive 830 is applied to select areas of web 800 in application step 840. Releasable adhesive 850 is applied to select areas of web 800 in application step 860. A surface of web 800 bearing pressure sensitive adhesive 830 is applied to release paper 910 in application step 920 such that the resulting labels produced from this process may later be removed for application to container P. In application step 880, protective material 870 (e.g. lacquer, varnish (such as ultra violet varnish), PVC, or other substantially transparent protective material) is applied to select surfaces of web 800 which surfaces generally do not contain pressure sensitive adhesive 830. In die cutting step 940, substrate web 800 (along with any protective material 870) is die cut to form label blanks, perforations, and/or other openings (if any) in web 800. In stripping step 960, substrate waste 950 is removed from release paper 910 after die cutting step 940 thereby leaving finished label blanks releasably adhered to release paper 910 for later application to container P. Finally, in optional rewinding step 980, release paper 910 bearing die cut label blanks may be wound into rolls or other convenient form for later application of the resulting labels to container P or other objects by manual or automated means.

Figure 17:
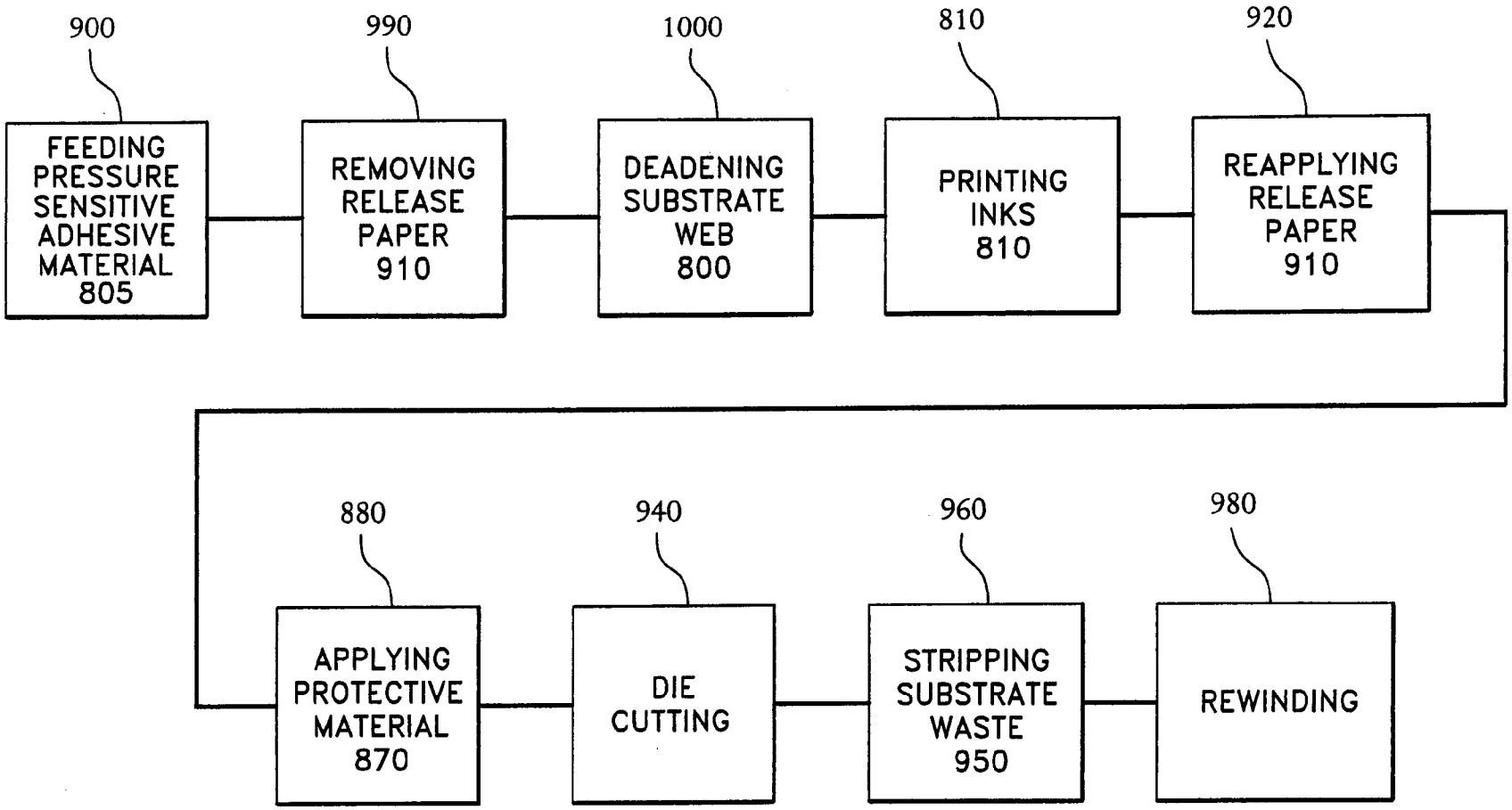
FIG. 17 is a schematic depicting another method for making the labels of this invention.

FIG. 17 depicts another method for making labels according to aspects of the present invention, which method is similar to the method set forth in FIG. 16, except that substrate web 800 is replaced with a pressure sensitive adhesive (PSA) material 805. PSA material 805 may include substrate web 800 releasably adhered to release paper 910 by pressure sensitive adhesive 830, which adhesive 830 is typically coated on one side of web 800. In step 900, PSA material 805 is fed through a series of process steps. Each such step is represented schematically by a box in FIG. 17. Again, the order in which the steps of this method are carried out is not necessarily critical to the successful manufacture of the labels of this invention. With this in mind, in step 990 release paper 910 is removed from PSA material 805 to expose pressure sensitive adhesive 830.

As discussed above, in certain embodiments of the labels according to aspects of the present invention, it may be desirable to have certain portions of the label which are coated with pressure sensitive adhesive 830 (see e.g. portions 116, 216 and 316 of FIGS. 2 through 4 respectively and portions 416, 516, 616 and 716 of FIGS. 7 through 10 respectively) in certain areas which are intended to be indicia or ink bearing surfaces (see e.g. second portions 114, 214 and 314 of FIGS. 2 through 4 respectively and 414, 514, 614 and 714 of FIGS. 7 through 10 respectively). When PSA material 805 is provided with pressure sensitive adhesive 830 in areas where it is necessary or desirable to print indicia or inks 810, such areas may be "deadened" by either removing pressure sensitive adhesive 830 from web 800 or by applying a detackifying material such as a varnish, laminate or other material capable of providing, a suitable surface for the printing of indicia or inks 810. This deadening process is particularly useful when it is necessary or desirable to print on the surface of web 800 which surface also bears pressure sensitive adhesive 830 (see e.g. surface 118 of FIG. 5).

The deadening process (if any is required) may be carried out in step 1000. With PSA material 805 prepared, web 800 may be printed with inks 810 on any surface of the label which is suitable for accepting inks 810. Such printed surfaces may include both top and bottom surfaces of the label being produced, any surface not bearing pressure sensitive adhesive 830, or any surface which has been deadened in step 1000, for example. Printing step 810 may include one or more steps wherein the top and bottom surfaces of the label are printed either simultaneously or in separate steps. In one embodiment of the invention, inks 810 are printed on the top surface of the PSA material 805, PSA material 805 is turned over, and inks 810 are printed on the bottom surface of PSA material 805.

In step 920, release paper 910 is reapplied to web 800 with pressure sensitive adhesive 830. Reapplication step 920 may occur at any time after printing step 810 is completed with respect to the surface of the label which also bears pressure sensitive adhesive 830.

As in the method depicted in FIG. 16, application of protective material 870 may take place in step 880, die cutting of individual labels takes place in step 940, substrate waste 950 is stripped away in step 960, and the resulting web which bears the finished die cut label blanks is rewound in step 980.

Figure 19B:
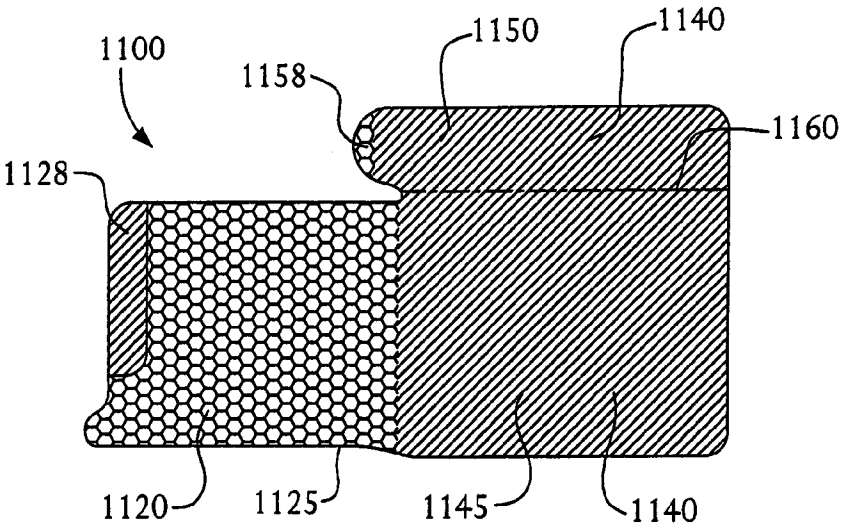
FIGS. 19A and 19B are schematics depicting front- and back-plan views of a label according to an embodiment of the present invention; and, FIGS. 20A and 2B illustrate plan views of an embodiment of a label constructed according to an aspect of the present invention having a tear strip and removable sheet.
Figure 19A:
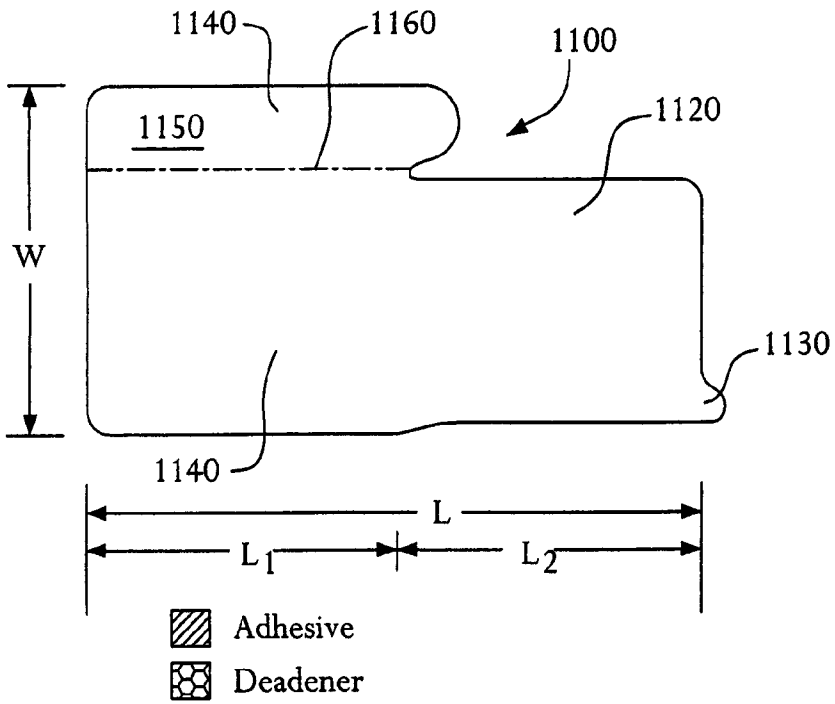

Referring now to FIGS. 19A and 19B, there is illustrated an embodiment of a label which may effectively alleviate the problem of limited print space associated with conventional wrap labels such as label 10 of FIG. 1.

A label according to this embodiment of the present invention is identified by reference numeral 1100 in FIGS. 19A and 19B. Label 1100 may be comprised of a flexible and printable substrate such as paper or plastic sheet or web material. The plastic substrate may be shrinkable. Although it may be made individually, the label may be produced from rolls of such substrates, such as paper or plastic sheet stock which can be continuously printed, coated with adhesive, applied with protective material, affixed to release paper, and cut to produce multiple labels as further described herein.

Each label 1100 has general dimensions L and W which represent length and width dimensions, respectively, of the label 1100. Length L is a predetermined distance related to the circumferential dimension of the object to be labeled and width W is that dimension extending substantially perpendicularly to length L. Width W may vary, as may be desired or necessary, along length L.

Label 1100 includes a first portion 1140 having a length $L_1$. $L_1$ may be less than or equal to the circumferential dimension of the object to be labeled. In addition, label 1100 includes a second portion 1120 of length $L_2$ substantially contiguous with first portion 1140. Second label portion 1120 may provide additional length to first label portions 1140 such that the total length L of label 1100 is greater than the circumference of the object to be labeled. All or a portion of the underside of first label portions 1140 may be coated with a layer of pressure sensitive or other adhesive 1145 having sufficient tackiness to essentially affix the label about a target object, such adhesive being shown in FIG. 19B.

The second label portion 1120 provides additional print space to label 1100. Indeed, both the top and bottom surfaces of the second label portions may be available as printable surfaces depending upon design criteria. Further, depending on which of certain other structural features, described below, are incorporated into a label of the present invention, second label portion 1120 may function, without limitation, as a resealable and/or removable flap.

The length $L_2$ of second portion 1120 may be dictated by, inter alia, a need for additional print space. A primary practical limitation on the second label portion length $L_2$ and, hence, the overall length L of label 1100 may be that, if L results in multiple wraps of the second label portion 1120 about the target object, the several superimposed label layers may produce a label whose bulk and thickness rivals those of two-part (e.g., base label and leaflet) label constructions, however, the label of this invention may include any number of wraps of the second label portion about the target object. In fact, the multiple wraps embodiment of this invention may be preferable to known leaflet labels because multiple wraps provide, in most cases, an equal or greater amount of print area than would an equivalent leaflet label while providing a substantially uniform overall diameter to container P. A leaflet label providing an equivalent amount of print area may produce a bulge on the side wall of container P at the point where the leaflet is located thereby creating a non-symmetric overall cross section to container P.

Referring still to FIGS. 19A and 19B, according to an aspect of the present invention, label 1100 includes first and second portions 1140, 1120 which are substantially contiguous regions of an elongated unitary strip of material. No perforation may exist between first and second label portions 1140 and 1120, although one may be included. Physical demarcation between first label portion 1140 and second label portion 1120 may be established by the rightmost edge of a partial deadening 1125 of pressure sensitive adhesive underlying second portion 1120. The boundary between the first and second label portions 1140 and 1120 may also be distinguished by a change in width W and/or a printed image carried on the label.

Referring still to FIGS. 19A and 19B, the illustrated embodiment of the label 1100 further includes a non-deadened portion 1128 on the underside of portion 1120. The illustrated embodiment of the label 1100 further includes an extending peel-tab 1130 to assist a user with detaching and re-adhering the portion 1120 of the label 1100 about an object.

Referring still to FIGS. 19A and 19B, the illustrated embodiment of the label 1100 further includes a feature, device or means 1140 for evidencing tampering of product prior to consumption thereof by an end user. According to a construction, tamper evident feature, device or means 1140 may include a fixed or disposable tear strip 1150 substantially contiguous with either the second 1120, the first and second 1120, or as shown, the first portion 1140 of label 1100 along perforation 1160. Tear strip 1150 may be of any length, but may substantially correspond to the length $L_1$. The tear strip 1150 may be configured such that when torn, it removes substantially all of the means 1140, or such that only a portion of the means 1140 is removed leaving behind a portion thereof, as a cap labeling for the container for example, thereby further increasing available billboard, as is well understood in the pertinent arts.

The illustrated embodiment of the label 1100 further includes a partially deadened portion 1158 on the underside of tear strip 1150. This is optional, and need not be included however. The partially or fitting deadened portion 1158 may be used by a user to assist with partially detaching or removing the tamper evident tear strip 1150.

Figure 20A:
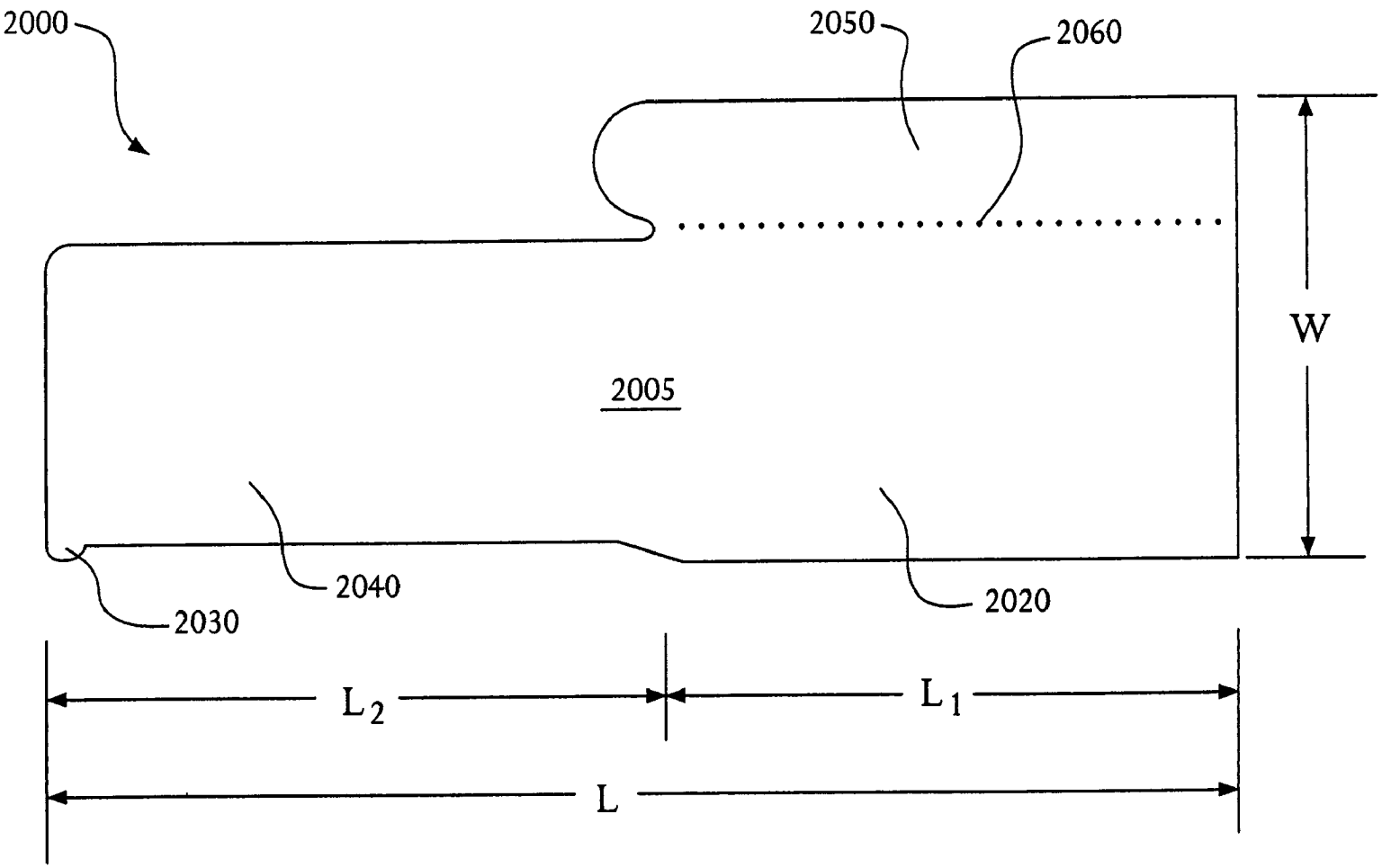
Figure 20B:
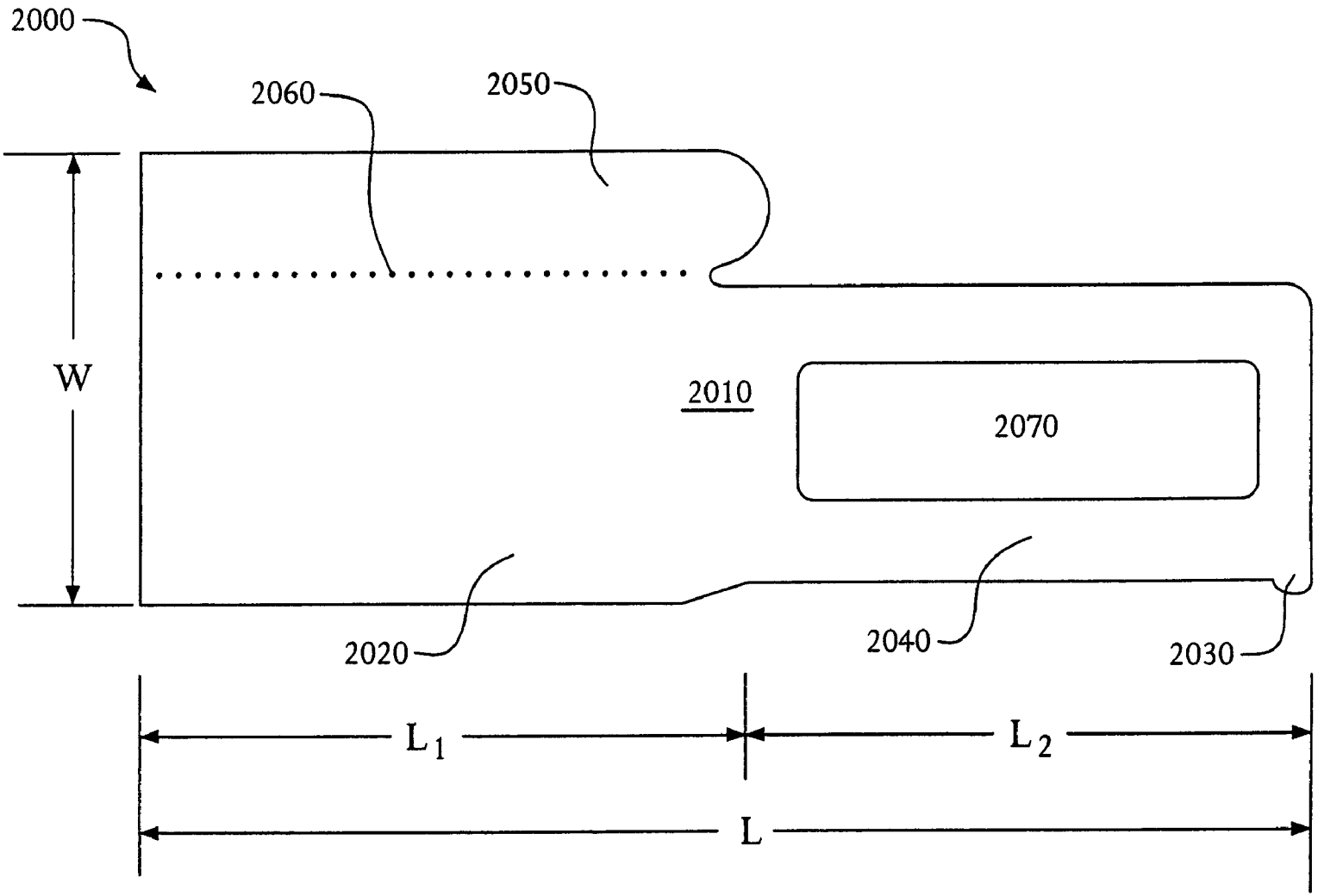

A label according to an aspect of the present invention is identified by reference numeral 2000 in FIGS. 20A and 20B. FIG. 20A illustrates a first surface 2005 of label 2000, while FIG. 20B illustrates a second surface 2010 of label 2000, being oppositely disposed from surface 2005. Again, label 2000 may be comprised of a flexible and printable substrate such as paper or plastic sheet or web material which substrate may also be shrinkable. Although it may be made individually, the label may be produced from rolls of such substrates, such as paper or plastic sheet stock which can be continuously printed, coated with adhesive, applied with protective material, affixed to release paper, and cut to produce multiple labels as further described herein.

Each label 2000 has general dimensions L and W which represent general length and width dimensions, respectively. Length L may be a predetermined distance related to the circumferential dimension of object to be labeled and width W is that dimension extending substantially perpendicularly to length L. Width W may vary, as may be desired or necessary, along length L.

Label 2000 includes a first portion 2020 having a length $L_1$. $L_1$ may be less than or equal to the circumferential dimension of the object to be labeled. In addition, label 2000 includes a second portion 2040 of length $L_2$ substantially contiguous with first portion 2020. Second label portion 2040 may provide additional length to first label portions 2020 such that the total length L of label 2000 is greater than the circumference of the object to be labeled. The widths of portions 2020, 2040 may be consistent, or the width of one portion may be greater than that of the other. In the illustrated and non-limiting case of FIGS. 20A, 20B portion 2020 may be seen to be wider than portion 2040. However, portion 2040 could be wider than portion 2020, or portions 2020, 2040 could have a substantially similar width.

Second label portion 2040 provides additional print space to label 2000. Indeed, both the top and bottom surfaces of the second label portion 2040 may be available as printable surfaces depending upon design criteria. Further, second label portion 2040 may function, without limitation, as a resealable and/or removable flap. Label 2000 may incorporate any and/or all of the features discussed with regard to the labels depicted in the previous figures.

The length $L_2$ of second portion 2040 may be dictated by, inter alia, a need for additional print space. A primary practical limitation of the second label portion length $L_2$ and, hence, the overall length L of label 2000, may be that if L results in multiple wraps of the second label portion 2040 about a target object, the several superimposed label layers may produce a label whose bulk and thickness rivals those of two-part (e.g., base label and leaflet) label constructions, however, a label according to the present invention may include any number of wraps of the second label portion about the target object. In fact, a multiple wrap embodiment of this invention may be preferable to known leaflet labels because multiple wraps provide, in most cases, an equal or greater amount of print area than would an equivalent leaflet label while providing a substantially uniform overall diameter to container P.

Referring still to FIGS. 20A and 20B, all, or a portion, of the underside of first label portions 2020, e.g. surface 2010, may be coated with a layer of pressure sensitive (PSA) or other adhesive having sufficient tackiness to essentially affix label 2000 about a target object. A PSA, or other suitable adhesive, may be provided on the surface 2010 corresponding to portion 2040. Physical demarcation between first label portion 2020 and second label portion 2040 may be established by a leftmost edge of a partial deadening of pressure sensitive adhesive on portion 2040. The boundary between the first and second label portions 2020 and 2040 may also be distinguished by a change in width W and/or a printed image carried on the label, although such is not necessary.

Referring still to FIGS. 20A and 20B, label 2000 may further include peel-tab 2030 to assist a user with detaching and re-adhering portion 2040 of label 2000 to an object. Deadener on underside 2010 of peel tab 2030 may deaden adhesive, if applied thereto, either partially or completely, for example.

Referring still to FIGS. 20A and 20B, the illustrated embodiment of the label 2000 further includes means for evidencing tampering of product prior to consumption thereof by an end user. According to a construction, tamper evident means may include a fixed or disposable tear strip 2050 substantially contiguous with either the second portion 2040, the first portion 2020 and second portion 2040, or as shown, the first portion 2020 of label 2000 along perforation 2060. Tear strip 2050 may be of any length, but may substantially correspond to the length $L_1$. Tear strip 2050 may be configured such that when torn, it removes substantially all of the tamper evidence means, or such that only a portion of the tamper evidence means is removed leaving behind a portion thereof, as a cap labeling for the container for example, thereby further increasing available billboard, as such term is well understood in the pertinent arts.

Tear strip 2050 may incorporate any and/or all, and operate substantially analogously to, the tear strips of the previously described embodiments.

For example, tear strip 2050 may, or may not, include a partially deadened area on surface 2010 that may be used by a user to assist with partially detaching or removing it, analogously to area 1158 of FIG. 19B, for example.

According to an aspect of the present invention, label 2000 may include a removable, and optionally re-adherable planar member, or sheet, 2070. Sheet 2070 may include indicia on one or more surfaces. For example, sheet 2070 may be provided for use by a party downstream in the distribution of product to which label 2000 has been affixed. By way of non-limiting example, sheet 2070 may take the form of a coupon that may be removed during, or after, a purchase of an object to which label 2000 is affixed to, for example. Sheet 2070 may take the form of a product registration form, for example.

According to an aspect of the present invention, sheet 2070 may take the form of a portion of release liner secured to label 2000 in a conventional manner. Of course, release liners are conventionally provided as mechanical support for labels, however the release liner does not conventionally form part of the label itself. However, by using a portion of the release liner supporting label 2000 as part of label 2000 itself, sheet 2070 may be advantageously provided at no further materials cost. Where sheet 2070 takes the form of a portion of a release liner to which label 2000 is secured, the release liner may be die cut form a side opposite from label 2000 to provide sheet 2070. When the remainder of the release liner is detached from label 2000 during application of label 2000 to a product, sheet 2070 may thus remain releasably attached to surface 2010 via the PSA material of surface 2010, for example.

First label portion 2020 of label 2000 may be wrapped about and adhered about a circumference of container P such that surface 2005 is facing outwardly. Second label portion 2040 may be releasably adhered to surface 2005 of portion 2020 (which may be accomplished by partially deadening PSA on surface 2010 corresponding thereto), so as to enable lifting and turning-away, thereof to expose the bottom surface 2010 thereof. Both the top and bottom surfaces of second portion 2040 may be available as printable surface areas. As previously discussed, a tackiness of surface 2010 of portion 2040 may be such that it may enable the second label portion 2040 to be releasably adhered, (e.g., selectively and repeatedly adhered), to the first label portion 2020.

Sheet 2070 may be sandwichedly coupled between the first and second label portions 2020 and 2040 once label 2000 is affixed about an object. By first peeling portion 2040 from portion 2020, sheet 2070 may be accessed. Sheet 2070 may then be viewed, removed and/or reattached for example, prior to readhering portion 2040 to portion 2020. Of course, portion 2040 may be re-secured to portion 2020 without reintroducing sheet 2070 therebetween.

The backside of that portion of the release liner corresponding to sheet 2070 may be provided in any corresponding manner.

If printing on the side of sheet 2070 adhesively coupled to surface 2010 of label 2000 is desired, label 2000 may be temporarily detached from the liner prior to die cutting, printing on that surface, and then reattached thereto to facilitate die cutting of sheet 2070 from the remainder of the liner and delivery of labels 2000 with liner.

More particularly, and as discussed with regard to FIG. 17 for example, PSA material on surface 2010 may be releasably adhered to release paper, which adhesive is typically coated on one side of a web of label material. The PSA material may be fed through a series of process steps. The release paper may be removed from the PSA material to expose the pressure sensitive adhesive. A deadening process (if any is required) may be carried out. With PSA material exposed, the web may be printed with inks on any surface of the label 2000 which is suitable for accepting inks. Printing may include one or more steps wherein the top and bottom surfaces of the label are printed either simultaneously or in separate steps. For example, inks may be printed on the top surface of the PSA material, the PSA material turned over, and inks printed on the bottom surface of the PSA material. Portions of the PSA may be deadened. The release paper, or release liner, may then be reapplied to the web with the pressure sensitive adhesive.

As in the method depicted in FIG. 16, application of protective material, die cutting of individual labels and sheets 2070, substrate waste being stripped away, and the resulting web which bears the finished die cut label blanks being rewound may all be accomplished:

Although the present invention has been described in detail for the purpose of illustration, it is to be understood that such detail is solely for that purpose and that variations can be made therein by those skilled in the art without departing from the spirit and scope of the invention.

What is claimed is:

1. A method for providing a label being suitable for being adhered about an object having a outer circumference once removed from a release liner, said label having a length greater than the circumference of said object and said release liner providing a mechanical support for said label prior to be adhered about said object, said method comprising:

printing at least a portion of said label with indicia;

printing at least a portion of said release liner with indicia; and, at least partially severing said printed portion of said release liner from said release liner such that upon removal of said label from said release liner, said printed portion of said release liner remains releasably adhered to an outer surface of said label when said label is adhered to said object.

* * * * *